US007281366B2

(12) United States Patent
Schweier

(10) Patent No.: US 7,281,366 B2
(45) Date of Patent: Oct. 16, 2007

(54) ARRANGEMENT DEVICE FOR PRODUCING A SPUN THREAD

(75) Inventor: Peter Schweier, Geislingen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/548,812

(22) PCT Filed: Feb. 14, 2004

(86) PCT No.: PCT/EP2004/001402

§ 371 (c)(1),
(2), (4) Date: May 30, 2006

(87) PCT Pub. No.: WO2004/081268

PCT Pub. Date: Sep. 23, 2004

(65) Prior Publication Data

US 2006/0236673 A1 Oct. 26, 2006

(30) Foreign Application Priority Data

Mar. 13, 2003 (DE) ..... 103 11 826

(51) Int. Cl.
*D01H 7/02* (2006.01)

(52) U.S. Cl. ..... 57/350; 57/304

(58) Field of Classification Search ..... 57/315, 57/333, 350, 400, 403, 304
See application file for complete search history.

(56) References Cited

U.S. PATENT DOCUMENTS 4,107,911 A 8/1978 Yamana et al.
4,412,413 A 11/1983 Sakai et al.
5,390,485 A 2/1995 Mori
5,560,194 A * 10/1996 Shofner et al. ..... 57/264
5,694,759 A * 12/1997 Caviness ..... 57/408
5,699,659 A * 12/1997 Caviness ..... 57/245
6,295,800 B1 * 10/2001 Stahlecker ..... 57/411

FOREIGN PATENT DOCUMENTS

EP 1 207 225 A 5/2002
GB 1 492 508 A 11/1977

* cited by examiner

*Primary Examiner*—Shaun R. Hurley
(74) *Attorney, Agent, or Firm*—Crowell & Moring LLP

(57) ABSTRACT

An arrangement for producing a spun thread from a staple sliver including a drafting unit and an air jet aggregate arranged downstream thereof. A vortex chamber with an air evacuation channel is located in the air jet aggregate. A cleaning channel is arranged to the delivery roller pair of the drafting unit, which cleaning channel is connected, together with the air evacuation channel to a joint vacuum source. The cleaning channel runs preferably into the air evacuation channel in the inside of the air jet aggregate. The cleaning channel is preferably aligned against the pressure roller of the delivery roller pair. Further suction openings can be additionally arranged to the bottom rollers of the drafting unit, which suction openings are also connected to the joint vacuum source.

16 Claims, 1 Drawing Sheet

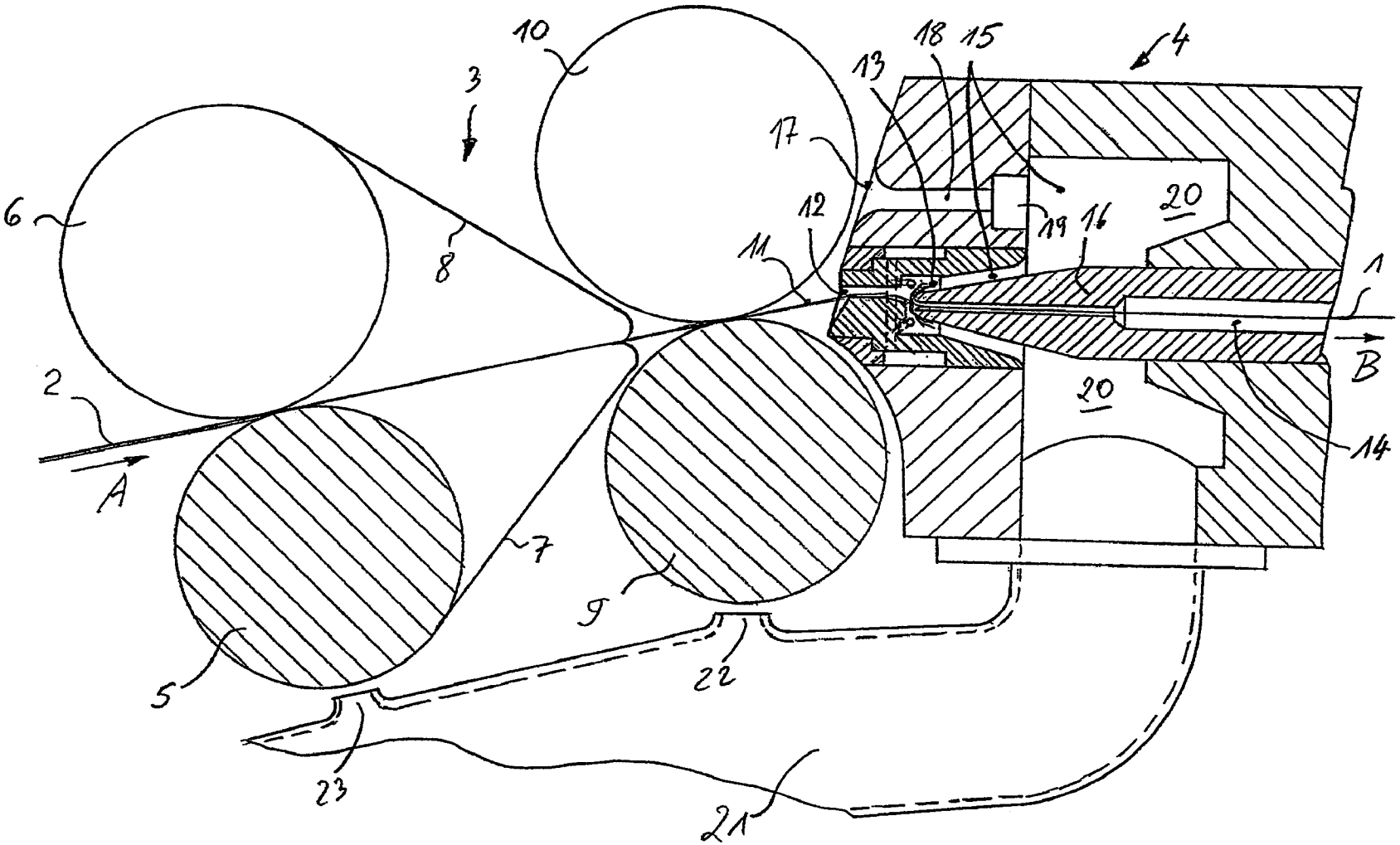
1
B
14
4
20
20
14
19
15
18
13
17
12
11
10
3
8
7
9
22
21
23
5
6
2
A

ARRANGEMENT DEVICE FOR PRODUCING A SPUN THREAD

BACKGROUND AND SUMMARY OF THE INVENTION

The present invention relates to an arrangement for producing a spun thread from a staple sliver, with a drafting unit comprising a delivery roller pair, also comprising an air jet aggregate arranged downstream of the drafting unit, which air jet aggregate comprises an air evacuation channel, and comprising a cleaning channel arranged to the delivery roller pair and comprising a suction opening.

An arrangement of this type is known in European patent application 1 207 225. In the case of this arrangement, a staple sliver is drafted to a fiber strand, which is imparted its spinning twist in the air jet aggregate. The fiber strand is fed first through an entry channel of the air jet aggregate into a vortex chamber, to which is arranged a fluid device for generating a turbulent airflow around an inlet opening of a yarn withdrawal channel. The front ends of the fibers held in the fiber strand are hereby first fed into the yarn withdrawal channel, while rear, free fiber ends are spread out, seized by the turbulent airflow and twisted around the bound-in front ends already located in the entry opening of the yarn withdrawal channel, whereby a thread with a mostly true twist is formed.

An arrangement of this type permits high spinning speeds, whereby high demands are made above all on the drafting unit arranged upstream of the air jet aggregate. In particular, fiber fly tends to settle on the circumferential surfaces of the delivery roller pair, which rotates especially rapidly. For this reason, a suction opening of a cleaning channel is arranged to the delivery roller pair of the known arrangement, which cleaning channel ensures that the delivery roller pair is kept clear of fiber fly. The above mentioned publication does not specify to which vacuum source the cleaning channel is connected, but it can be seen from the patent figures, that in the case of the air evacuation channel and the cleaning channel, different vacuum sources are provided.

It is an object of the present invention to provide a particularly simple design for the arrangement of the above mentioned type.

This object has been achieved in that the air evacuation channel and the cleaning channel are both connected to the same vacuum source.

It has been shown that the low pressures, which on the one hand are necessary for the air evacuation channel and on the other hand for the suctioning of the delivery roller pair, do not differ from each other to such an extent that they could not be achieved by means of a joint vacuum source, for example, a joint blower. This measure results, from the point of view of the technical design, ill significant spacesaving in an area which is already spatially very narrow, and also to a significant simplification of the production process.

In an embodiment of the present invention it is provided that the cleaning channel runs into the air evacuation channel in the interior of the air jet aggregate. Where the cleaning channel runs into the air evacuation channel, the latter can take the form of a ring channel in this area.

The air jet aggregate usually comprises an entry channel which leads to the vortex chamber, to which entry channel the cleaning channel advantageously extends at least approximately parallel. This permits the vortex chamber arranged downstream of the entry channel, as well as the cleaning channel, to be connected in a simple manner to the air evacuation channel. The suction opening of the cleaning channel can be aligned at a distance from the entry channel against a pressure roller of the delivery roller pair. Tests have shown that the pressure roller of the delivery roller pair is particularly susceptible to fiber fly. The distance mentioned above corresponds for the purpose of the present invention approximately to the radius of the pressure roller.

In a further embodiment of the present invention, further suction openings can be arranged to the driven bottom rollers of the drafting unit in the areas facing away from their respective pressure rollers, which suction openings are also advantageously connected to a joint vacuum source. Thus with one single vacuum source, not only can the air involved in the spinning process be withdrawn from the air jet aggregate, but also the entire drafting unit is kept clean.

These and further objects, features and advantages of the present invention will become more readily apparent from the following detailed description thereof when taken in conjunction with a spinning aggregate shown enlarged and schematically in intersection.

BRIEF DESCRIPTION OF THE DRAWINGS

The single drawing FIGURE depicts an arrangement constructed according to preferred embodiments of the invention.

DETAILED DESCRIPTION OF THE DRAWINGS

The arrangement shown in the drawing serves the production of a spun thread 1 from a staple sliver 2. The arrangement comprises a drafting unit 3 as well as an air jet aggregate 4 as essential component parts.

The staple sliver 2 to be spun is fed to the drafting unit 3 in delivery direction A and withdrawn as a spun thread 1 in withdrawal direction B and then guided further to a winding device (not shown).

The drafting unit 3, shown only in part, is preferably a three-cylinder drafting unit and comprises overall three roller pairs, each having a driven bottom roller and an upper roller in the form of a pressure roller. Downstream of a front roller pair (not shown) is a roller pair 5,6 which is provided with guiding belts 7 and 8, as well as a delivery roller pair 9,10. The relevant, driven bottom rollers are denoted by the numbers 5 and 9, while the respective pressure rollers are denoted by the numbers 6 and 10. In a drafting unit 3 of this type, the staple sliver 2 is drafted to the desired degree of fineness in the known way. Directly downstream of the drafting unit 3, a thin fiber strand 11 is present, which is drafted, but not yet twisted.

The air jet aggregate 4, arranged downstream of the drafting unit 3 at a short distance thereto, and which imparts the spinning twist, can, in the present invention, be of any design, whereby, however, the design according to International published application 02/24993 is preferably considered, as this type of air jet aggregate permits particularly high delivery speeds.

The fiber strand 11 is fed via an entry channel 12 to the air jet aggregate 4. Arranged downstream thereof is a so-called vortex chamber 13, in which the fiber strand 11 is imparted the spinning twist, so that the spun thread 1 is created, which is withdrawn through a yarn withdrawal channel 14. A fluid device generates turbulent air currents in the vortex chamber 13 by means of blowing in compressed air through compressed air jets which run tangentially into the vortex chamber 13. The compressed air which exits out of the jet openings is guided through an evacuation channel 15, whereby this channel 15 has a ring-shaped cross section surrounding a spindle-shaped stationary component 16, which comprises the yarn withdrawal channel 14.

In the area of the vortex chamber 13, an edge of a fiber guiding surface is arranged as a twist block, said edge being arranged slightly ecentrically to the yarn withdrawal channel 14 in the area of its entry opening.

In the arrangement shown, the fibers to be spun are held on the one hand in the fiber strand 11 and thus are fed from the entry channel 12, essentially without being imparted any twist, to the yarn withdrawal channel 14. On the other hand, the fibers in the area between the entry channel 12 and the yarn withdrawal channel 14 are subject to the effect of the turbulent air currents, by means of which the fibers or at least their end areas are driven radially away from the entry opening of the yarn withdrawal channel 14. The threads 1 formed by means of the above described process thus have a core of fibers or fiber areas extending essentially in the thread longitudinal direction without any significant twist, as well as an outer area, in which the fibers or fiber areas are wound around the core area.

Basing the formation of the thread structure on an idealized process for the purposes of greater clarity, it can be said that the structure of the thread 4 forms because the front running ends of the fibers, in particular those whose rear areas are still held upstream by the entry channel 12, essentially reach the yarn withdrawal channel 14 directly, whereas the fiber areas following behind, in particular when they are no longer held in the entry area to the entry channel 12, are pulled out of the fiber strand 11 due to the rotating air current and then are twisted around the forming thread 1. In any case, fibers are bound into the forming thread 1, whereby they are pulled through the yarn withdrawal channel 14, and are simultaneously subject to the effects of the rotating current, which centrifugally accelerate the fibers, that is from the inlet opening of the yarn withdrawal channel 14 onwards, from where they are sucked into the air evacuation channel 15. The fiber areas pulled out of the fiber strand 11 by the circulating air currents form a fiber vortex, the so-called sun, which runs into the entry opening of the yarn withdrawal channel 14, the longer parts of which so-called sun winding themselves spiral-like around the spindle-shaped entry area of the yarn withdrawal channel 14 and this spiral being drawn against the entry opening of the yarn withdrawal channel 14 contrary to the force of the current in the air evacuation channel 15.

An arrangement of this type permits particularly high spinning speeds, which lie in the range of 600 meters per minute. It is clear that the drafting unit 3 is subject to great pressures, because the delivery roller pair 9,10 must rotate very fast due to the required high drafting performance. This results inevitably in the delivery roller pair 9,10 and in particular its pressure roller 10 being susceptible to heavy fiber fly caused by fiber loss. For this reason, a suction opening 17 of a cleaning channel 18 is arranged to the pressure roller 10 of the delivery roller 9,10.

In contrast to the above described prior art, the cleaning channel 18 provided for the present invention runs into the inside of the air jet aggregate 4 ir, the air evacuation channel 15. This is designed as a ring channel 20 in the running in area 19 of the cleaning channel 18, said ring channel 20 surrounding the spindle-shaped component 16.

As can be seen, the cleaning channel 18 extends at least approximately parallel to the entry channel 12 leading into the vortex chamber 13. This permits the suction opening 17 of the cleaning channel 18 to be aligned against the pressure roller 10 of the delivery roller pair 9,10 at a certain distance from the entry channel 12. This distance should correspond approximately to the radius of the pressure roller 10.

This embodiment of the arrangement permits the air evacuation channel 15 and the cleaning channel 18 to be connected to a joint vacuum source 21, which is shown here as a suction tube, but which for the purpose of the present invention leads to a blower (not shown). Further suction openings 22 and 23 could be connected to this joint vacuum source 21, which openings are arranged to the driven bottom rollers 5,9 as well as to the front bottom roller arranged upstream (not shown) in areas facing away from the relevant pressure rollers 6, 10. Thus in a simple way, the spinning air is expelled and the drafting unit 3 is kept clean.

The invention claimed is:

1. Arrangement for producing a spun thread from a staple sliver, comprising:

a drafting unit including a delivery roller pair;

an air jet aggregate arranged downstream of the drafting unit, which air jet aggregate comprises an air evacuation channel;

a cleaning channel, wherein the air evacuation channel and the cleaning channel are connected to a single vacuum source, and individual suction openings connected to the single vacuum source, one suction opening being respectively assigned, and arranged proximal to, a circumference of a respective roller of the delivery roller pair.

2. An arrangement according to claim 1, wherein the cleaning channel runs into the inside of the air jet aggregate in the air evacuation channel.

3. An arrangement according to claim 2, wherein the air evacuation channel is designed as a ring channel in the area of entry into the cleaning channel.

4. An arrangement according to claim 1, wherein the air jet aggregate comprises an entry channel which leads to a vortex chamber, wherein the cleaning channel extends approximately parallel to said entry channel.

5. An arrangement according to claim 4, wherein one of the individual suction openings of the cleaning channel is aligned at a distance from the entry channel opposite a pressure roller of the delivery roller pair.

6. An arrangement according to claim 5, wherein the distance corresponds approximately to the radius of one roller of said delivery roller pair.

7. An arrangement according to claim 1, wherein one of the individual suction openings is arranged to one roller of the roller pair of the drafting unit on an area facing away from the other roller of said roller pair, which individual suction openings are also connected to the single joint vacuum source.

8. An arrangement according to claim 2, wherein the air jet aggregate comprises an entry channel which leads to a vortex chamber, wherein the cleaning channel extends approximately parallel to said entry channel.

9. An arrangement according to claim 3, wherein the air jet aggregate comprises an entry channel which leads to a vortex chamber, wherein the cleaning channel extends approximately parallel to said entry channel.

10. An arrangement according to claim 2, wherein one of the individual suction openings is arranged to one roller of the roller pair of the drafting unit on an area facing away from the other roller of said roller pair, which suction openings are also connected to the single joint vacuum source.

11. An arrangement according to claim 3, wherein one of the individual suction openings is arranged to one roller of the roller pair of the drafting unit on an area facing away from the other roller of said roller pair, which suction openings are also connected to the single joint vacuum source.

12. An arrangement according to claim 4, wherein one of the individual suction openings is arranged to one roller of the roller pair of the drafting unit on an area facing away from the other roller of said roller pair, which suction openings are also connected to the single joint vacuum source.

13. An arrangement according to claim 5, wherein one of the individual suction openings is arranged to one roller of the roller pair of the drafting unit on an area facing away from the other roller of said roller pair, which suction openings are also connected to the single joint vacuum source.

14. Apparatus for producing a thread comprising:

a delivery roller pair including a pressure roller and a delivery roller;

a cleaning channel for cleaning said delivery roller pair;

an air evacuation channel for removing fibers shed by said thread during production;

a single vacuum source connected to both said cleaning channel and said air evacuation channel; and individual suction openings connected to the single vacuum source, one suction opening being respectively assigned, and arranged proximal to, a circumference of a respective one of the pressure roller and delivery roller.

15. The apparatus according to claim 14, wherein said cleaning channel is proximal to said pressure roller.

16. The apparatus according to claim 14, wherein said single vacuum source is proximal to said delivery roller.

* * * * *